US006457499B1

(12) United States Patent
Pousette

(10) Patent No.: US 6,457,499 B1
(45) Date of Patent: Oct. 1, 2002

(54) ROTARY RING DEBARKER WITH DEBARKER TOOLS ARRANGED IN OFFSET ROTARY DEBARKING PLANES

(76) Inventor: Ronald D. Pousette, 7936 Angus Drive, Vancouver, B.C. (CA), V6P 5K5

( * ) Notice: Subject to any disclaimer, the term of this patent is extended or adjusted under 35 U.S.C. 154(b) by 0 days.

(21) Appl. No.: 09/721,422

(22) Filed: Nov. 20, 2000

Related U.S. Application Data

(60) Provisional application No. 60/169,836, filed on Dec. 7, 1999.

(51) Int. Cl.[7] ..... B27L 1/00

(52) U.S. Cl. ..... 144/208.8; 144/208.1; 144/341

(58) Field of Search ..... 144/23.13, 208.1, 144/208.2, 208.8, 341

(56) References Cited

U.S. PATENT DOCUMENTS 2,725,908 A * 12/1955 Ednell et al. ..... 144/208.8
3,221,785 A * 12/1965 Valo ..... 144/208.8
3,245,443 A * 4/1966 Shields ..... 144/208.8
3,991,800 A * 11/1976 Palmquist ..... 144/341
4,657,056 A * 4/1987 Hutson ..... 144/208.8
4,784,196 A * 11/1988 Pousette ..... 144/208.8

* cited by examiner

*Primary Examiner*—W. Donald Bray
(74) *Attorney, Agent, or Firm*—Kolisch Hartwell Dickinson McCormack & Heuser

(57) ABSTRACT

A rotary ring log debarker including one or more rotary rings each carrying one or more sets of equiangularly distributed log debarking arms and tools, in such a manner that the overall machine includes at least two axially offset (leading and trailing) sets of debarking tool arms which perform debarking in two different axially spaced planes. The trailing edges of the tool tips in the leading arm set are spaced upstream from the leading edges of the tool tips in the trailing arm set.

4 Claims, 1 Drawing Sheet

ROTARY RING DEBARKER WITH DEBARKER TOOLS ARRANGED IN OFFSET ROTARY DEBARKING PLANES

CROSS REFERENCE TO RELATED APPLICATION

This application claims priority to provisional application Serial No. 60/169,836 entitled "Rotary Ring Debarker with Debarker Tools Arranged in Offset Rotary Debarking Planes" filed on Dec. 7, 1999, the disclosure of which is hereby incorporated by reference.

BACKGROUND AND SUMMARY OF THE INVENTION

This invention relates to a log debarker, and in particular to a rotary-ring-type log debarker which includes one or more rotary debarker rings that carry pivoted, inwardly biased debarking arms arranged in at least two different sets of arms.

According to the invention, and relative to the longitudinal direction in which a log that is to be debarked is transported, these arm sets are axially offset from one another in the machine, with the arms in each set effecfively occupying a common rotary debarking plane that is normal to the machine's long debarking axis. The debarking tool tips (or tools of various kinds) borne by the arms in these plural sets thus effectively occupy spaced debarking planes, with all tool tips in each associated set of arms occupying substantially the same plane (one of the mentioned debarking planes). With ring rotation, the arm tools in each set move in the associated rotary debarking plane.

Rotary-ring-type log debarkers have been around for years and are well known in the wood-products industry. It is typical for such a debarker to include a single, rotary, power-driven debarker ring (or rotor) on which there are mounted, typically pivotally, plural, elongate debarking arms, the inner or free ends of which carry appropriate debarking tool tips These tips may take the form, for example, of scraper blades, spinning abrader wheels, or scoring knives.

When there is no log to be debarked in such a machine, the inner ends of the debarking arms (i.e., the tool-tip ends or tool ends) lie very closely adjacent (but not in contact with) one another in a fashion circumsurrounding the long debarking axis of the machine, i.e., that axis along which a log that is to be debarked is conveyed. For each machine, this tool-end condition effectively limits the maximum number of arms which can be carried without the inner arm tips (or other arm parts) hitting one another near the long axis of the machine. It also thus further determines the minimum log debarking diameter which can be handled by a machine—a determination which requires key consideration in today's world where progressively smaller and smaller logs are being debarked.

Further, because of the fact that maximum practical debarking throughput speed in a debarker of the kind now being discussed is dependent, at least in part, on the number of arms that perform the debarking function (i.e., the more arms, the greater the achievable throughput speed), it is usually desirable to have the maximum number of arms possible.

Among other advantages offered by non-crowding of the center of a debarking ring by tool tips are (a) that more space is furnished for the expelling and removal of bark, and (b) that debarking arms, and/or their associated pivoting structures, such as arm pivot shafts for example, which can be designed as torque tubes to flex appreciably under a debarking load, thus to promote confident "following" of log irregularities through the "mechanism" of spring-loading and—unloading of the arms/shafts/tubes.

Regarding the important advantages that can be made available via such flexing capability, and considering certain shortcomings of prior art machines, any appreciable flexing of tool arms in current debarkers with closely spaced tool tips is not possible because tool's then hit one another.

The present invention addresses these considerations in a very satisfactory and practical way by incorporating, into such a machine, plural sets (at least two) of debarking arms—each set being axially offset in the machine along the long axis along which a log moves. Preferably, the arms in each set are equiangularly spaced about the debarking axis, and the arms in the plural sets, when such are viewed along the long debarking axis of the machine, also preferably all appear to be equiangularly displaced about that axis. These plural sets of arms may be carried on a single debarking ring—a circumstance which accommodates the use of, for example, two axially offset sets of arms—or they may be carried on more than two debarking rings or rotors—a situation in which each debarking rotor can have two or more sets of debarking arms. Where plural rotors are employed, the different rotors can turn either in the same, or different, direction(s).

By constructing a machine in this fashion, for a given debarking-arm tool-tip width, an overall greater number of arms (greater than the number conventionally permitted) can be incorporated without fear of their tool tips colliding with one another. Accordingly, a higher than conventional log throughput rate can be achieved, or, if desired, a log surface can be debarked twice for "cleaner" debarking with only one rotor.

These drawing figures are not necessarily drawn to scale.

Figure 1:
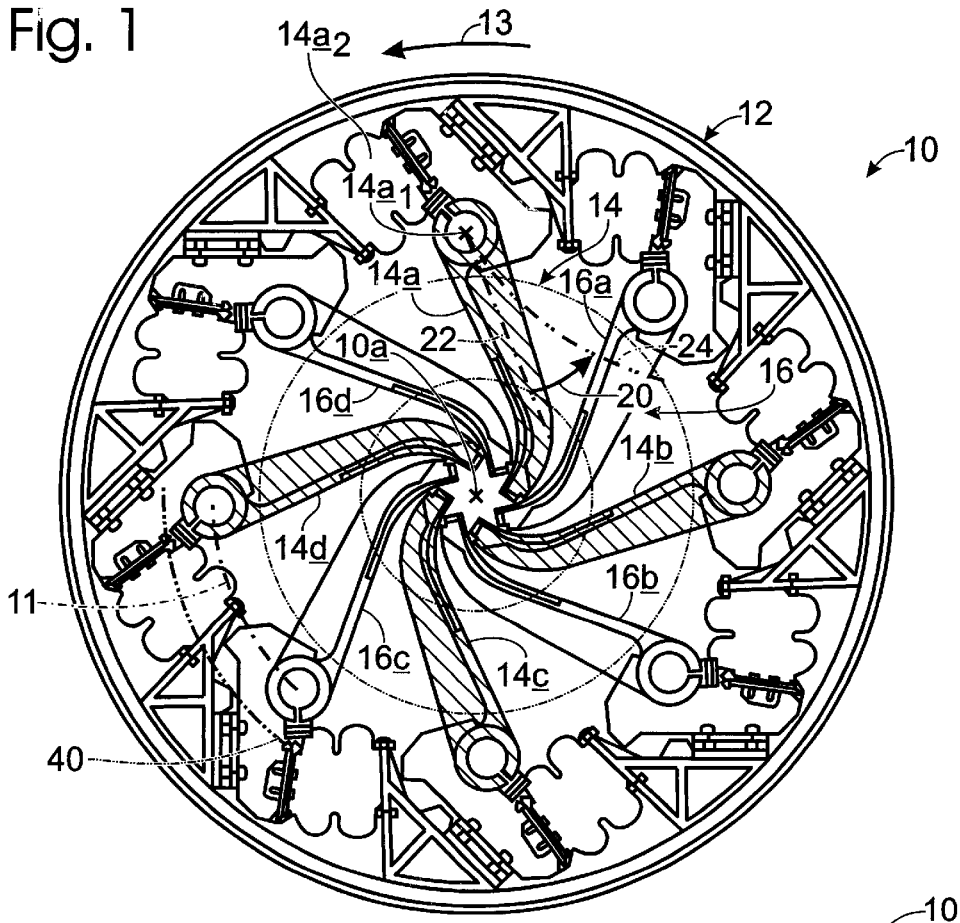
FIG. 1 provides an axial view toward a power-driven, rotary debarker ring (isolated from other structure) in a rotary-ring debarker which incorporates two sets of axially offset debarking arms constructed and mounted in accordance with this invention.
Figure 2:
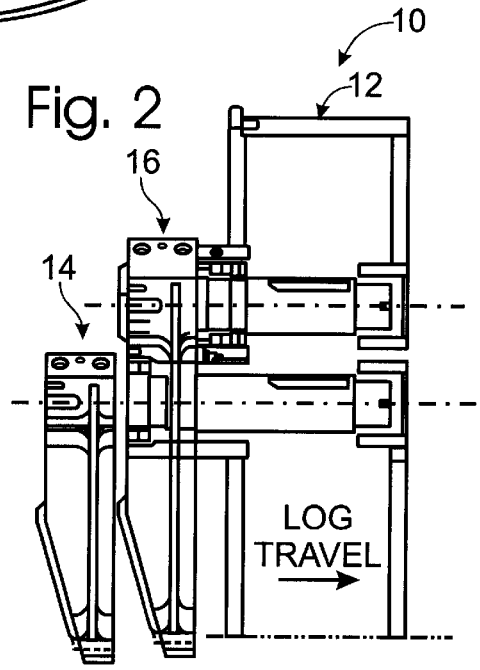
FIG. 2 is a fragmentary, internal, side/section view of the ring pictured in FIG. 1, showing the axial offset which exists between (a) the trailing edges of debarking tool tips in the leading set of debarking arms, and (b) the leading edges of debarking tool tips in the trailing set of debarking arms.

In FIGS. 1 and 2, 10 generally illustrates a rotary-ring-type debarker including, in the case now being described, a single debarking rotating ring assembly (rotor or ring) 12 which is appropriately mounted for power-driven rotation on an axis 10*a* in the direction of curved arrow 13 (see FIG. 1) during operation. Ring 10 is illustrated herein as including two sets of debarking arms (leading and trailing), with each set including four arms, and with the arms in each such set being angularly offset from one another (relative to the long debarking axis in the machine) by about 90°. Regardless of the number of arms present in a given set of arms, these arms are preferably equiangularly distributed on the associated rotor. These two sets of arms are shown at 14, 16, with leading set 14 including arms 14*a*, 14*b*, 14*c*, 14*d*, (shown slightly shaded in FIG. 1), and trailing set 16 including arms 16*a*, 16*b*, 16*c*, 16*d*. The terms "leading" and "trailing" relate to the direction of log travel through debarker 10, and to the order of engagements of a log by the two sets of arms. The arms in each set are anchored at their inner ends to a pivot shaft (or tube), such as shaft 14$a_1$ for arm 14*a* which is pivotally mounted on ring 12. All arms in debarker 10 have their pivot axes located on a pivot circle which is pictured in FIG. 1 by a dash-dot line 11. The tool-tip ends of the arms are urged toward axis 10*a* by pressure-fluid (such as air) bags, such as bag 14$a_2$ for arm 14*a*. Other pressuring or force-applying devices, such as pneumatic cylinders, can of course be used. FIG. 2 clearly shows that there is an axial offset between the trailing edges of the tool tips in arm set 14 and the leading edges of the tool tips in arm set 16.

As viewed effectively along the long axis 10*a* of the machine, the arms in the two sets are offset from one another angularly by about 45°. If, instead, the example given involved a machine with ten arms organized into two sets of five arms each, the "apparent" angular offset between "next adjacent" arms would be about 36°.

Figure 3:
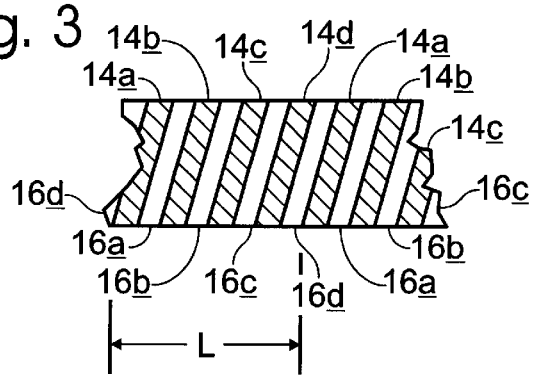
FIG. 3 illustrates, schematically, the "barberpole" debarking pattern "created" on the surface of a log which has been debarked by passing through the ring of FIGS. 1 and 2.

During a log debarking operation, the relative motions of tool tips over a log's surface create a debarked "barberpole" pattern like that shown in FIG. 3. The FIG. 3 illustrated pattern is idealized to reflect the assumption that the respective adjacent "stripes" of bark removal lie exactly next to each other. True spiral paths will show as parallel S-shaped curved lines in log side view. The total length of bark removed during a single revolution of ring 12 is shown at L in FIG. 3. L equals the axial width of each tool tip multiplied by the number of tool tips (eight in machine 10).

The invention thus proposes a way in which to include a large number of arms, with these arms, because of their organization into two offset debarking planes, being permitted to define a relatively small, ultimate central debarking "circle" which can accommodate, easily, small-diameter-log debarking, without these tool tips (or other arm or tool parts) contacting or running into one another. Clearing out of removed bark is advantageously promoted by the "less-crowded", more open center arrangement of tool tips within the debarking ring since bark removal and discharge is spaced into two (or more) zones (planes) rather than crowded into one.

Figure 4:
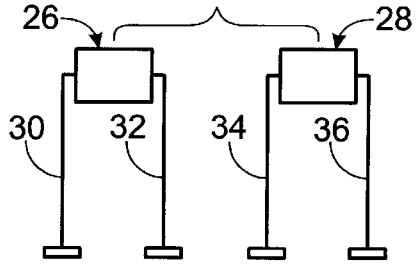
FIG. 4 is a simplified, schematic, isolated, internal side elevation showing one modified form of the invention which includes two rotary rings and four sets of debarking arms.

FIG. 4 shows (schematically) a modified form of structure built in accordance with the present invention. Here, two rotary debarking rings 26, 28, which are like previously-mentioned ring 12, are included. Each of these rings carries two sets of arms 30, 32 (ring 26), and 34, 36 (ring 28). The arms in each of these respective sets are angularly offset relative to one another by about 90°, and the total collection of arms, were they to be viewed (not shown specifically) along the long-debarking axis of a machine employing rings 26, 28, would appear to be angularly spaced from one another by about 22.5°. Rings 26, 28 thus collectively include sixteen debarking arms which can close down to define a quite small ultimate debarking "circle" without interfering with one another.

Another modified form of the invention is one wherein different sets of debarking arms are pivoted on pivot circles which have different radii. Referring especially to FIG. 1, dash-double-dot line 40 shows, partially, a pivot circle which has a larger radius than does previously mentioned pivot circle 11. Circles 11, 40 thus symbolically and collectively illustrate this modified form of a machine. A machine made in accordance with this kind of modified form of the present invention can advantageously provide additional space within the environment of the rotor to fit additional tool-arm actuating, or other related, devices.

With debarking arm sets offset in spaced debarking planes, the minimized, overall "central crowding" allows for yet another advance in debarker capability. Specifically, it permits one consciously to design arms and/or support structures therefore which load and unload like springs during a debarking operation. For example, arms can be designed to bend elastically and quite noticeably under load, as can also arm pivot shafts or torque tubes, without fear of their hitting one anther when they "spring back" to urge their tool tips toward the central debarking axis. Curved, dash-double-dot line 24 in FIG. 1 symbolically represents this important "springiness" performance capability and option furnished by the present invention.

Another important feature of this multiple plane arrangement of tool arms is that torsional forces on the log surface from scraping action of the debarking tools is distributed into at least two lineal locations on the log instead of being concentrated in one plane. This can result in reducing twisting off and breakage of small log "tops" which are becoming an ever increasing reality in utilization of fiber from small diameter logs.

Also the increased spacing of tool arms in each plane in this invention makes it possible to close the tool tips to an even smaller central "circle" to better debark smaller log "tops."

Various other advantages and features, as well as other possible modifications, will accordingly now be well understood by those skilled in the art based upon a reading of the disclosure provided herein.

It is desired top claim and secured by letters patent:

1. A rotary-ring log debarker having a frame, and a log-transport throughput axis extending through said frame, and along which logs to be debarked travel longitudinally during debarking, said debarker comprising at least first and second sets of plural debarking arms, each carrying a debarking tool-tip, power-driven rotary structure mounting said arm sets on said frame for rotation about said axis, said mounting structure effectively placing the tool tips which are associated with each said set of arms in a common debarking plane, which plane is axially offset, along said log-transport axis, in relation to another common debarking plane occupied by the tool tips associated with the other set of arms, this axial offset being such that the trailing edges of the tool tips in the leading arm set are spaced upstream relative to the leading edges of the tool tips in the trailing arm set, said mounting structure further disposing the tool tips in a manner whereby, as viewed generally along said log-transport axis, the tool tips associated with each individual arm set are spaced and distributed substantially equiangularly about the log-transport axis, and the tool tips collectively associated with both arm sets are distributed and spaced substantially equiangularly and interleavingly relative to one another about said axis.

2. The debarker of claim 1, wherein said rotary structure comprises a single rotary ring which carries both sets of arms.

3. The debarker of claim 1, wherein said rotary structure comprises two axially offset rotary rings, each carrying a different one of set arm sets.

4. The debarker of claim 1, wherein there are four sets of debarking arms, and said rotary structure includes two axially offset rotary rings, each carrying a different pair of said four sets of arms.

* * * * *